United States Patent [19]

Wolf

[11] Patent Number: 4,492,564

[45] Date of Patent: Jan. 8, 1985

[54] CLAMPING MEANS FOR MATRIX IN RADIANT GAS BURNER

[75] Inventor: Robert A. Wolf, Coventry, R.I.

[73] Assignee: Radiant Heat, Inc., Coventry, R.I.

[21] Appl. No.: 507,664

[22] Filed: Jun. 24, 1983

[51] Int. Cl.[3] ..... F23D 13/12

[52] U.S. Cl. ..... 431/328; 126/92 AC

[58] Field of Search ..... 431/328, 329; 126/92 AC, 92 B

[56] References Cited

U.S. PATENT DOCUMENTS

| | | | |
|---|---|---|---|
| 4,035,132 | 7/1977 | Smith | 431/328 X |
| 4,189,297 | 2/1980 | Bratko et al. | 431/328 |
| 4,224,018 | 9/1980 | Smith | 431/328 |
| 4,378,207 | 3/1983 | Smith | 431/328 X |
| 4,416,618 | 11/1983 | Smith | 431/328 |
| 4,435,154 | 3/1984 | Vigneau | 431/328 |

*Primary Examiner*—Randall L. Green

*Attorney, Agent, or Firm*—Barlow & Barlow

[57] ABSTRACT

A radiant gas burner construction is disclosed which utilizes a gas combustion mixture plenum closed on one side by a porous refractory matrix. The matrix is supported in the plenum by a plurality of clamping clips that extend about the marginal edge of the matrix and have inturned lips that engage the edge thereof, the clips being fastened to the external portion of the plenum. Non-combustible gas supply enclosures are provided that discharge a non-combustible gas around the edge of the combustion gas plenum by using plates that are spaced slightly away from the edge of the combustion gas plenum so that the non-combustible gas will be discharged down along the side of the gas plenum and then toward the free edge of the matrix adjacent the burning face thereof, or alternately into the edge of the matrix below the supporting clips so that an air seal is provided around the peripheral portion of the matrix.

2 Claims, 5 Drawing Figures

CLAMPING MEANS FOR MATRIX IN RADIANT GAS BURNER

BACKGROUND OF THE INVENTION

In the prior art relating to radiant gas burners which involve the utilization of a gas permeable matrix, one of the problems that is attendant to this type of gas burner is due to the heat that is generated on the face of the burner as that heat may damage the means that are holding the matrix in position. The problem of the heat that is generated on the surface of the matrix was first recognized in the Bratko U.S. Pat. No. 3,824,064; and subsequent to that time, suggestions of eliminating the problem by introducing air or other non-combustible gas at the periphery of the matrix have been made as for example, in Smith U.S. Pat. No. 4,035,132 and in Bratko et al. U.S. Pat. No. 4,189,297. In the Smith patent the perimeter of the matrix has a non-combustible gas forced therethrough from the rear face so that it is in close proximity to the mounting brackets, and in this way the gas mixture is kept away from the perimeter of the matrix so that no burning occurs. In the Bratko patent '297 the entire face of the matrix is devoted to burning gas, and, around the edges where the brackets are located to hold the matrix in place, a non-combustible curtain of gas is forced so as to prevent heat spill-over and to cool the mounting means.

In practice, the structure as disclosed in the Bratko '297 patent has shown some difficulties in gas spill-over, that is, the burning of gasses around and over the edge of the matrix. The curtain of air passing out through the narrow passageways does not completely control the spill-over effect, and a need is seen to provide a simple yet effective structure for mounting the matrix and introducing non-combustible air around the periphery thereof.

One of the principal objects of this invention, therefore, is to provide a radiant gas burner which utilizes a permeable matrix and which is easily fastened with edge clips to a gas air mixture plenum.

A further object of the invention is to provide a curtain of non-combustible gas passing down the side of the plenum matrix which gas is directed toward the edge of the matrix so as to dilute the air gas combustible mixture and prevent spill-over.

Another object of the invention is to provide a structure that increases the radiant surface relative to the outside dimensions of the entire burner structure.

Still another object of the invention is to provide a structure in which non-combustible gas may be introduced near the burning face of the matrix through the edge thereof so as to prevent spill-over.

With these and other objects in view, the invention consists of certain novel features of construction as will be more fully described and particularly pointed out in the appended claims.

DETAILED DESCRIPTION OF THE PREFERRED EMBODIMENTS

Figure 1:
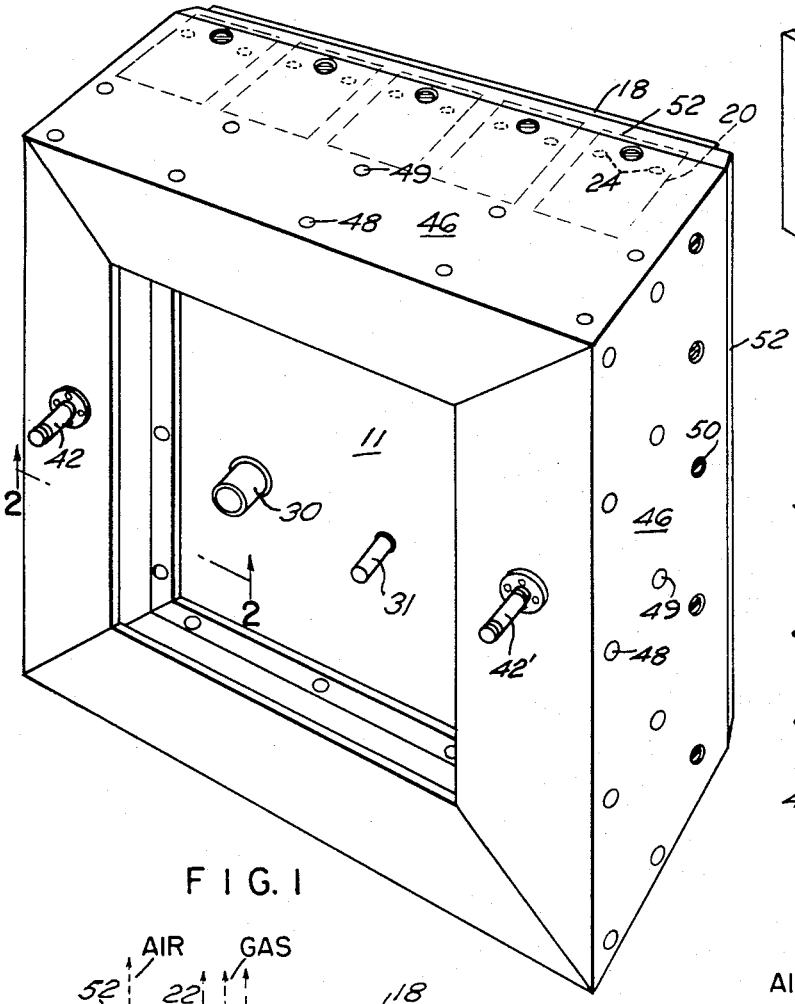
FIG. 1 is a perspective view of the radiant gas burner of the invention taken from the back side thereof opposite the matrix.

The radiant gas burner of the instant invention consists essentially of an air gas plenum which may be suitably formed of sheet metal to provide a wall 11, a pair of side walls 12 and a pair of edge walls 13. Extending about the side walls 12 and the edge walls 13 is an angle plate support shelf 15 which forms an engagement surface against which a matrix may rest, which shelf is spotwelded, as at 16, to the plenum side walls. The matrix which is formed of a fibrous refractory felt-like material, is fastened against the angle plate 15 by a plurality of clips 20, which clips are provided with a lip 22 that extend at right angles to the general planar extent of the clip, and which lips 22 may be forced into the edge of the matrix 18. The clips in turn are provided with apertures 24 through which fastening devices shown in the form of rivets 26 may pass into the walls 12 and 13 of the plenum and apertures 25 for a self-tapping fastener. Suitable sealing may be provided about the fastening means (and between lip 22 and plenum walls 12, 13 along with abutting clip 20) to prevent the escape of gaseous material; and since it is also important to prevent the escape of gas about the edges of the matrix, the edge of the matrix may be suitably coated about its edge as at 27 and inner face against the shelf 15 as at 28 by the utilization of a number of sealant devices such as silicone rubber and the like.

The gas/air plenum may be suitably fed with the proper combustion mixture through an inlet pipe 30 which passes through the wall 11. Also passing through the wall 11 is a pressure measuring port 31. Within the plenum and fastened to the wall 11 is a baffle means in the form of a baffle plate 32 with a number of apertures such as 33 therethrough which tend to equalize the combustion mixture flow toward the matrix 18.

Fastened to the wall 11 of the plenum by fastening means 38 is a non-combustible gas conduit formed as an extrusion 40 of general C-shape, with a pair of enlarged ends as at 43, 44. The individual extrusions may be mitered together at the corners thereof, with the mitered joints sealed as by cementing or welding together, and the open side of the C-shaped extrusion is closed off by a series of plates such as 46, which are fastened to the enlarged portions 44, 44 as by fasteners 48 and 49 respectively, and are fastened to the plenum wall **12*b* by self-tapping screws 54. The plates extend downwardly substantially parallel to the fastening clips 20, but in spaced relationship thereof, which spaced relationship is insured by the utilization of some rounded rolled-in holes as seen at 50, and which plates terminate with a partially inturned end as at 52. The plates are also suitably spaced away from the portions 44 as at 49' to provide an ample passageway for non-combustible gas. Delivery of non-combustible gas to the conduit is effected through inlets 42, 42'. Baffles may be used as necessary so that the delivery between plate 46 and the edge of the matrix is substantially uniform and so that the non-combustible gas is uniformly delivered from the interior and thence in the space between the matrix holding clip and the plate toward the edge of the matrix where the air impingement on the corners of the matrix will dilute the gas mixture to a point where it will not be combustible and thereby prevent any flare-ups. It will be apparent that with this structure, plates 20** are kept cool and will not warp. In addition, the non-combustible gas, which has diluted the air/gas mixture, mixes with the hot products of combustion and impinges on the product being heated, thus adding convection heating to the radiation heating. For a system such as this to operate properly, as mentioned, certain baffling will be necessary within the C-shaped extrusion which is not shown for the sake of clarity; it also being preferred to provide more than one inlet around the periphery to insure that there be a static pressure within the non-combustible gas extrusion or conduit, that is at least a half to one inch of water above ambient atmosphere, which is sufficient to provide a very effective air curtain to dilute the combustible mixture at the exposed edges of the matrix.

Figure 3:
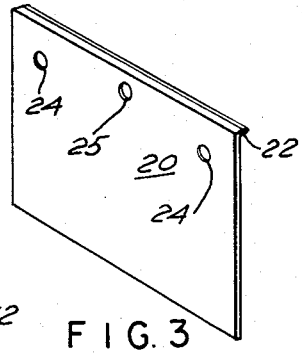
FIG. 3 is a perspective view of the clips that hold the matrix in position.
Figure 5:
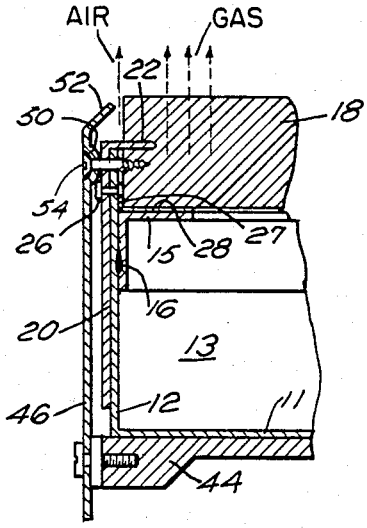
FIG. 5 is an enlarged view of the edge of the burner.
Figure 2:
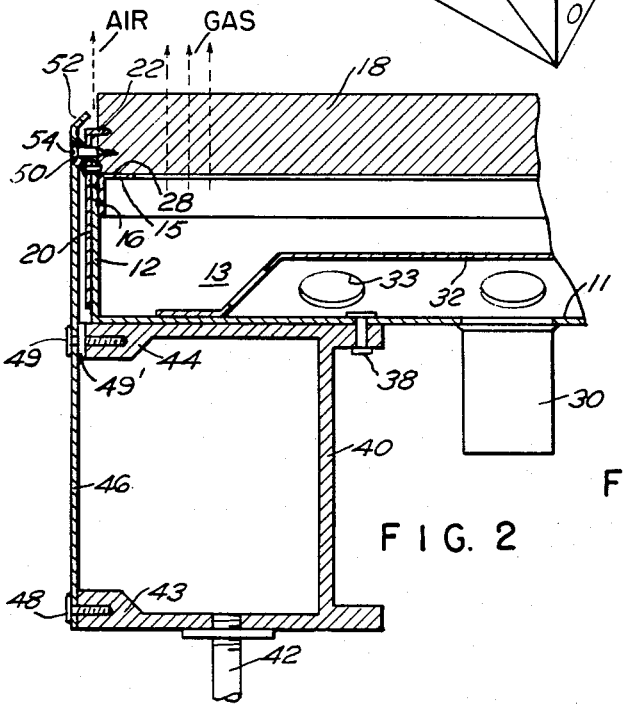
FIG. 2 is a sectional view taken on lines 2—2 of FIG. 1.
Figure 4:
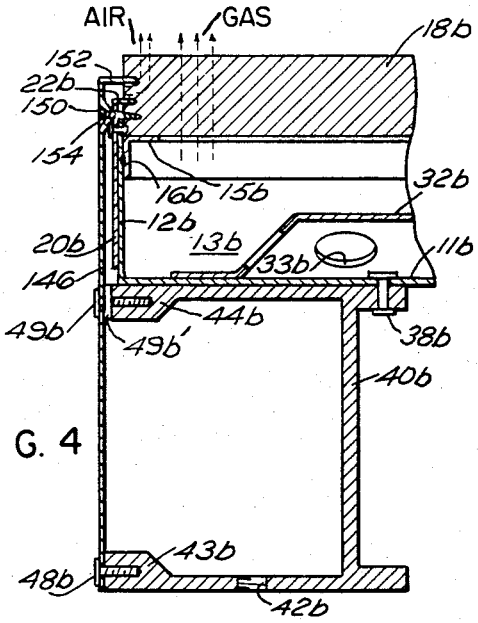
FIG. 4 is a sectional view of a modified form of the invention taken in the same position as FIG. 2.

Referring now to FIG. 4, a still further modification of the arrangement has been illustrated in which like reference numerals with the letter "b" suffix refer to like parts of the FIGS. 1–3 embodiments. In this embodiment the plate 146 that extends from the extrusion containing the non-combustible gas terminates in a substantially right angular end below the inturned lip portion **22*b* of the clip 20*b*. To this end, the plate 146 is formed with a spacing device in the form of a rounded depressed hole as at 150, and the inturned right angular end is suitable designated 152. To maintain engagement into the matrix, a fastener such as a self-tapping screw 154 may be used which engages the clip 20*b* and plenum wall 12*b* and passes partially into the matrix. With this particular construction, the non-combustible gas that passes down through the wall spacing will be inserted directly into the matrix adjacent the peripheral exposed edge thereof so as to dilute the gaseous mixture that is passing through the matrix and provide, in effect, complete dilution at the peripheral edge of the matrix. Sealant, such as silicone rubber, extends along the edge of the matrix under clips 20 and between adjacent edges thereof. In addition, sealant extends along shelf 15*b***. In this particular arrangement, it is necessary to increase slightly the pressure of the non-combustible gas since it now meets resistance of the matrix and it may be suitable to have approximately $1\frac{1}{2}$ to $2\frac{1}{2}$ inches of water above ambient atmosphere to provide the necessary pressure to direct the non-combustible gas through approximately one-half thickness of the matrix.

I claim:

1. A radiant gas burner comprising a gas permeable matrix, a combustion gas plenum having means to support the marginal edges of the matrix, a plurality of clamping clips about the marginal edge of the matrix, said clips fastened to the plenum and having inturned terminal edges engaging the matrix, a non-combustible gas supply enclosure, said enclosure having plate means extending in spaced relation to said clips and terminating beyond the clips, said plate means having inturned terminal edges to direct a stream of non-combustible gas on the marginal matrix edge.

2. A radiant gas burner comprising a gas permeable matrix, a combustion gas plenum having means to support the marginal edges of the matrix, a plurality of clamping clips about the marginal edge of the matrix, said clips fastened to the plenum and having inturned terminal edges engaging the matrix, a non-combustible gas supply enclosure, said enclosure having plate means extending in spaced relation to said clips and terminating beyond the clips to direct a stream of non-combustible gas on the marginal matrix edge, said plate means having a terminal edge extending at substantially right angles to the planar extent of the plate, said terminal edges entering the matrix body on a line spaced toward the exposed face of the matrix from the clamping clip terminal edge to force non-combustible gas into the edge of the matrix immediately adjacent the exposed face thereof whereby the non-combustible gas passing through the edge of the matrix prevents combustible flare-up at the exposed marginal edge of the matrix.

* * * * *